United States Patent [19]

Scheurecker et al.

[11] 4,428,415

[45] Jan. 31, 1984

[54] STRAND GUIDE ARRANGEMENT TO BE USED IN A CONTINUOUS CASTING PLANT HAVING THE FORM OF AN ARC

[75] Inventors: Werner Scheurecker, Linz; Erich Felbermayer, Wels; Alfred Nagl, Steyr, all of Austria

[73] Assignee: Voest-Alpine Aktiengesellschaft, Linz, Austria

[21] Appl. No.: 193,755

[22] Filed: Oct. 3, 1980

[30] Foreign Application Priority Data

Oct. 22, 1979 [AT] Austria ..... 6874/79

[51] Int. Cl.[3] ..... B22D 11/12

[52] U.S. Cl. ..... 164/448; 164/442

[58] Field of Search ..... 164/448, 447, 484, 442; 193/35 R, 35 TE; 226/189, 190; 105/182 R; 198/574, 631

[56] References Cited

U.S. PATENT DOCUMENTS

| | | | |
|---|---|---|---|
| 1,521,820 | 1/1925 | Lloyd | 198/631 |
| 3,627,026 | 12/1971 | Bohne et al. | 164/448 |
| 3,710,847 | 1/1973 | Schoffmann | 164/448 |
| 3,763,923 | 10/1973 | Gallucci | 164/448 |
| 3,995,683 | 12/1976 | Guyot et al. | 164/448 |
| 4,146,083 | 3/1979 | Scheurecker et al. | 164/448 |

FOREIGN PATENT DOCUMENTS

| | | | |
|---|---|---|---|
| 290038 | 5/1971 | Austria . | |
| 1239440 | 4/1967 | Fed. Rep. of Germany . | |
| 1294603 | 5/1969 | Fed. Rep. of Germany . | |
| 1285095 | 8/1969 | Fed. Rep. of Germany . | |
| 1920757 | 10/1973 | Fed. Rep. of Germany . | |
| 2425883 | 5/1976 | Fed. Rep. of Germany . | |
| 7217120 | 6/1973 | Netherlands | 164/448 |
| 1414342 | 11/1975 | United Kingdom . | |

*Primary Examiner*—Gus T. Hampilos
*Assistant Examiner*—Jerold L. Johnson
*Attorney, Agent, or Firm*—Brumbaugh, Graves, Donohue & Raymond

[57] ABSTRACT

A strand guide for an arcuate continuous casting plant has at least one arcuate, horizontally displaceable supporting and guiding structure. In order to be able to remove and install the supporting and guiding structure in a simple manner, on ensuring a good accessibility and not restricting the space on the casting platform, the supporting and guiding structure is mounted on at least one intermediate trestle. The intermediate trestle is adjustable in the arc plane and is supported on at least one supporting trestle which is adjustable transversely to the arc plane.

1 Claim, 5 Drawing Figures

STRAND GUIDE ARRANGEMENT TO BE USED IN A CONTINUOUS CASTING PLANT HAVING THE FORM OF AN ARC

BACKGROUND OF THE INVENTION

The present invention relates to a strand guide for an arcuate continuous casting plant, in particular a continuous casting plant for steel slabs, comprising at least one arcuate, horizontally displaceable supporting and guiding structure.

From U.S. Pat. No. 3,710,847 and from U.S. Pat. No. 4,146,083 it is known to move an arcuate supporting and guiding structure in the horizontal direction in the arc plane out of the continuous casting plant. This has the advantage that no consuming means are necessary therefor; it suffices to provide but a car that is movable on rails (U.S. Pat. No. 4,146,083) and on which the supporting and guiding arc can be placed, or it is also possible to provide wheels directly on the supporting and guiding structure (U.S. Pat. No. 3,710,847). Yet, very much space is necessary with these designs in the arc plane, thus requiring a large hall construction.

It is furthermore known from German Pat. Nos. 2,425,883 and 1,285,095 to remove, in the arc plane, shorter supporting and guiding structures which, one adjacent the other, form a quarter-circularly arc-shaped structure at first transversely to the strand direction in the direction to the center of the curvature of the arcuate supporting and guiding structure and then vertically upwardly. This mode of construction necessitates complex and consuming guides for the parts to be removed, which guides occupy the space as far as to the center of the curvature of the supporting and guiding structure, thus limiting the space and the clearness on the casting platform; the accessibility to the individual parts of the plant is also impaired in these known constructions.

According to German Auslegeschrift No. 1,920,757 it is furthermore known to move such shorter supporting and guiding structures radially outwardly in the arc plane for the purpose of removing them, then displace them downwardly outside of the arcuate supporting and guiding structure along the same and afterwards move them horizontally out of the plant. With this construction, not only are very consuming rail guides with shunts, etc. necessary, but the space and thus the accessibility to the plant are also greatly impaired.

SUMMARY OF THE INVENTION

The invention aims at avoiding these disadvantages and difficulties and has as its object to provide a strand guide of the initially-defined kind in which the displaceable supporting and guiding structure is easily removable and installable, wherein however a good accessibility to the plant is ensured, the space on the casting platform is not restricted and a hall size as small as possible suffices.

These objects are achieved according to the invention in that the supporting and guiding structure is mounted on at least one intermediate trestle which is adjustable in the arc plane, and that the intermediate trestle is supported on at least one supporting trestle which is displaceable transversely to the arc plane.

According to a preferred embodiment, both the intermediate trestle and the supporting trestle are designed as bogies, the intermediate trestle being displaceable on rails arranged horizontally on the bogies and in the arc plane, and wherein, suitably, stationarily arranged pressure medium cylinders that can be coupled to the supporting and guiding structure or to the supporting trestle, respectively, are provided for displacing the supporting and guiding structure in the arc plane as well as at a right angle thereto. The use of pressure medium cylinders for instance has the advantage over traction motors arranged on the bogies that no electrical feed lines have to be provided, which would be undesired in the water-actuated cooling chamber. Pressure medium cylinders are advantageous also over continuous chain or rope drives in that they can be better and more simply protected from contamination by cinders and rust.

It is of a particular advantage if, for displacing the supporting trestle, a pressure medium cylinder is provided which exhibits a shorter stroke than the total displacement path of the supporting trestle, wherein the supporting trestle can be coupled to an extension of the piston rod of the pressure medium cylinder at different distances from the pressure medium cylinder, since thereby a relatively short pressure medium cylinder will suffice.

BRIEF DESCRIPTION OF THE DRAWINGS

The invention will now be explained in more detail with reference to the accompanying drawings, wherein.

DETAILED DESCRIPTION OF EXEMPLARY EMBODIMENT

Figure 1:
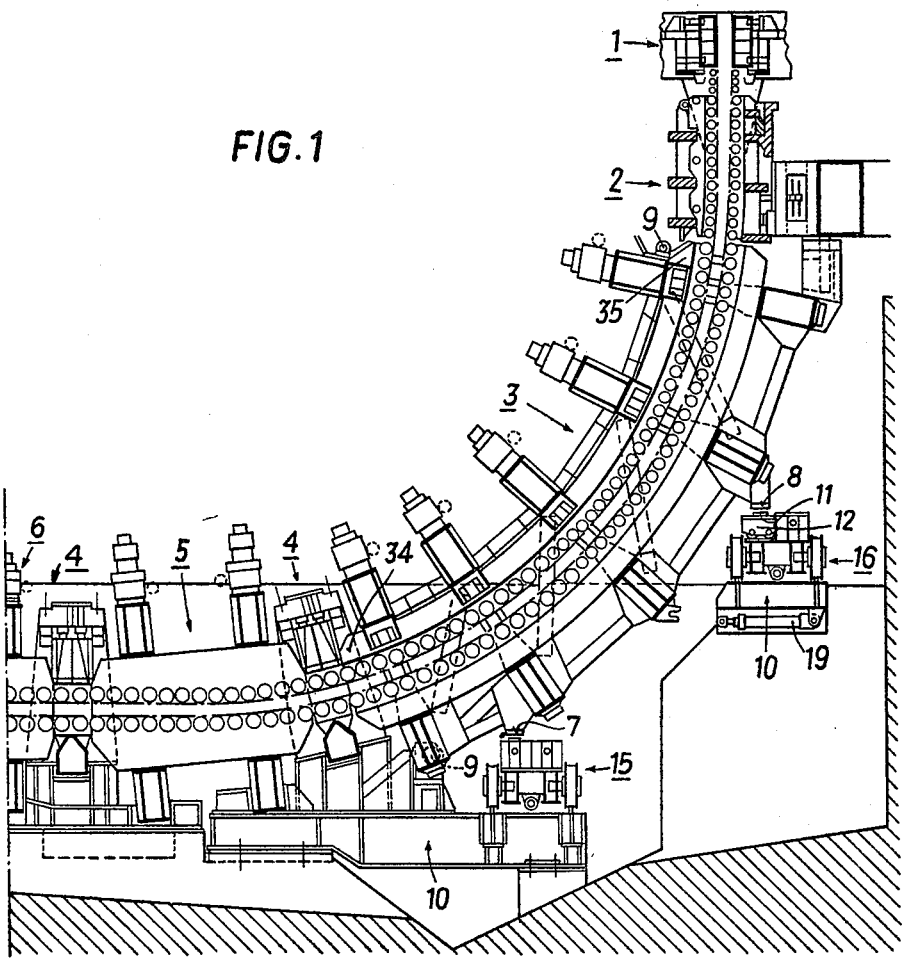
FIG. 1 is a schematic side view of a continuous casting plant.

Below a mould 1, there is a bending zone 2, upon which a circularly-arc-shaped, approximately quarter-circularly-arc-shaped, one-part supporting and guiding structure 3 for the strand follows. In further sequence, a driving roll stand 4 and then a straightening aggregate 5 with a further driving roll stand 4 subsequently arranged, and a horizontal strand guide 6 following thereupon, are provided. The arcuate supporting and guiding structure 3, on its outer side, comprises chased supporting surfaces 7, 8, each arranged in pairs at different heights, by which supporting surfaces it is placeable on one counter supporting surface 11 each, of an intermediate trestle 12, after detachment of its fastening means 9 on the stationary supporting trestle 10 and lowering by means of lifting elements, such as pressure medium cylinders, wherein each supporting surface 7, 8 is allocated its own intermediate trestle 12 comprising a counter supporting surface 11.

Each intermediate trestle 12 is designed as a bogie, and can be moved by wheels 13 on rails 14 that are arranged horizontally in the arc plane. These rails 14 are mounted on supporting trestles 15, 16, wherein each supporting trestle also is designed as a bogie, which is movable by wheels 17 on rails 18 arranged horizontally and at a right angle to the arc plane. Each pair of supporting surfaces 7 and 8, respectively, arranged at the same height is accorded its own supporting trestle 15 and 16, respectively. The rails 18 are mounted on the stationary supporting trestle 10.

Figure 2:
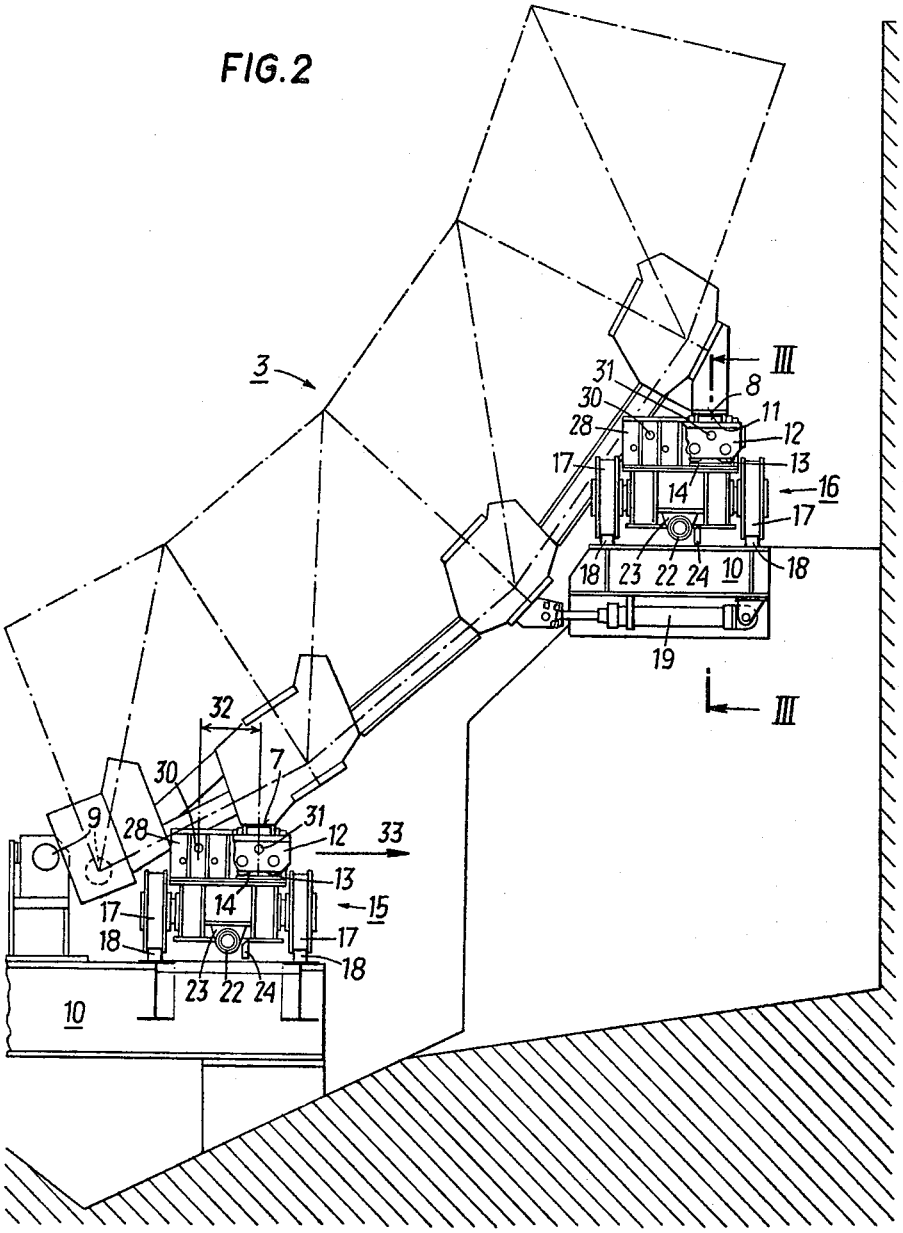
FIG. 2 is an analogous illustration with the supporting and guiding structure lowered.

For displacing the supporting and guiding structure 3 in the arc plane, a pressure medium cylinder 19 serves, which is provided below the upper supporting trestle 16, stationarily mounted on the supporting trestle 10 and connectable to the supporting and guiding structure 3. In FIG. 1 the pressure medium cylinder is illustrated in the retracted, decoupled position, whereas in FIG. 2 it is illustrated in the coupled-in position.

Figure 3:
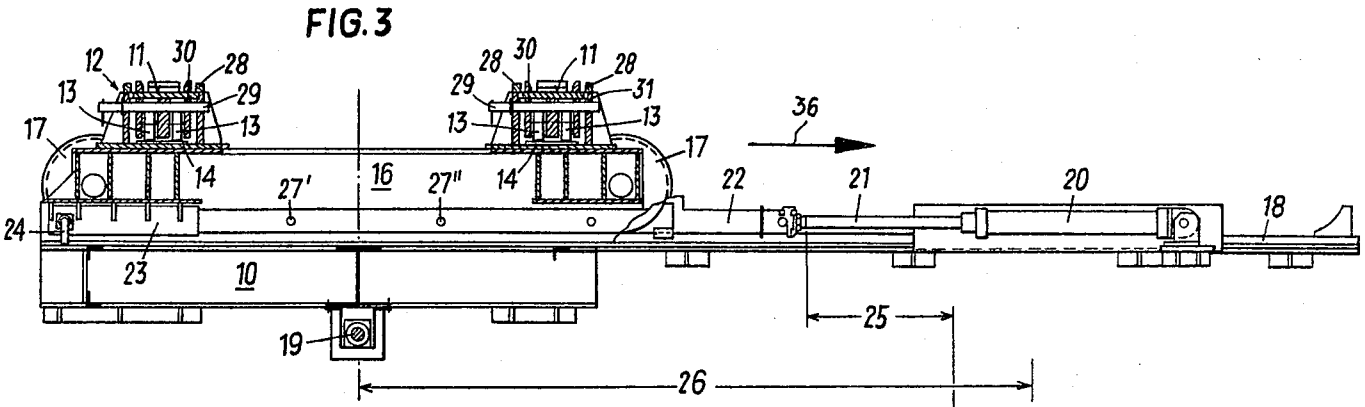
FIG. 3 is a section according to line III—III of FIG. 2 on an enlarged scale.
Figure 4:
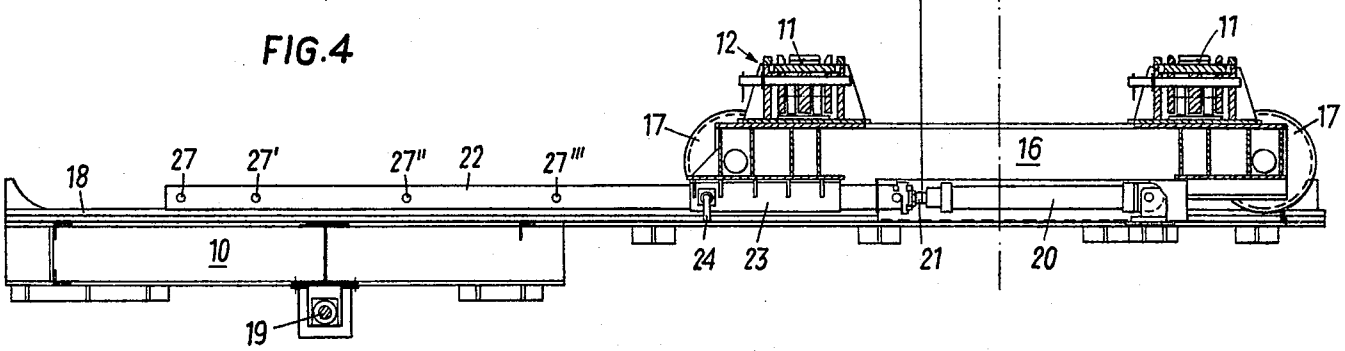
FIG. 4 illustrates, in a manner analogous to FIG. 3, a supporting trestle moved in its outermost end position.

For displacing the supporting trestles 15, 16, one pressure medium cylinder 20 each serves, as illustrated in FIG. 3, on whose piston rod 21 a pipe 22 is mounted as an extension. This pipe 22 projects as far as into a sleeve 23 of the supporting trestle 15 and 16, respectively, and is connectable with this sleeve 23 by means of a pin 24 manually removable and insertable. The stroke 25 of the pressure medium cylinder 20 amounts to only a fraction of the total displacement path 26. The pipe 22 comprises several bores 27, 27', 27'', 27''', . . . distributed over its length, into which the pin 24 may be inserted, the sleeve 23 thus being fastenable to the pipe 22 at different distances from the pressure medium cylinder 20.

Figure 1A:
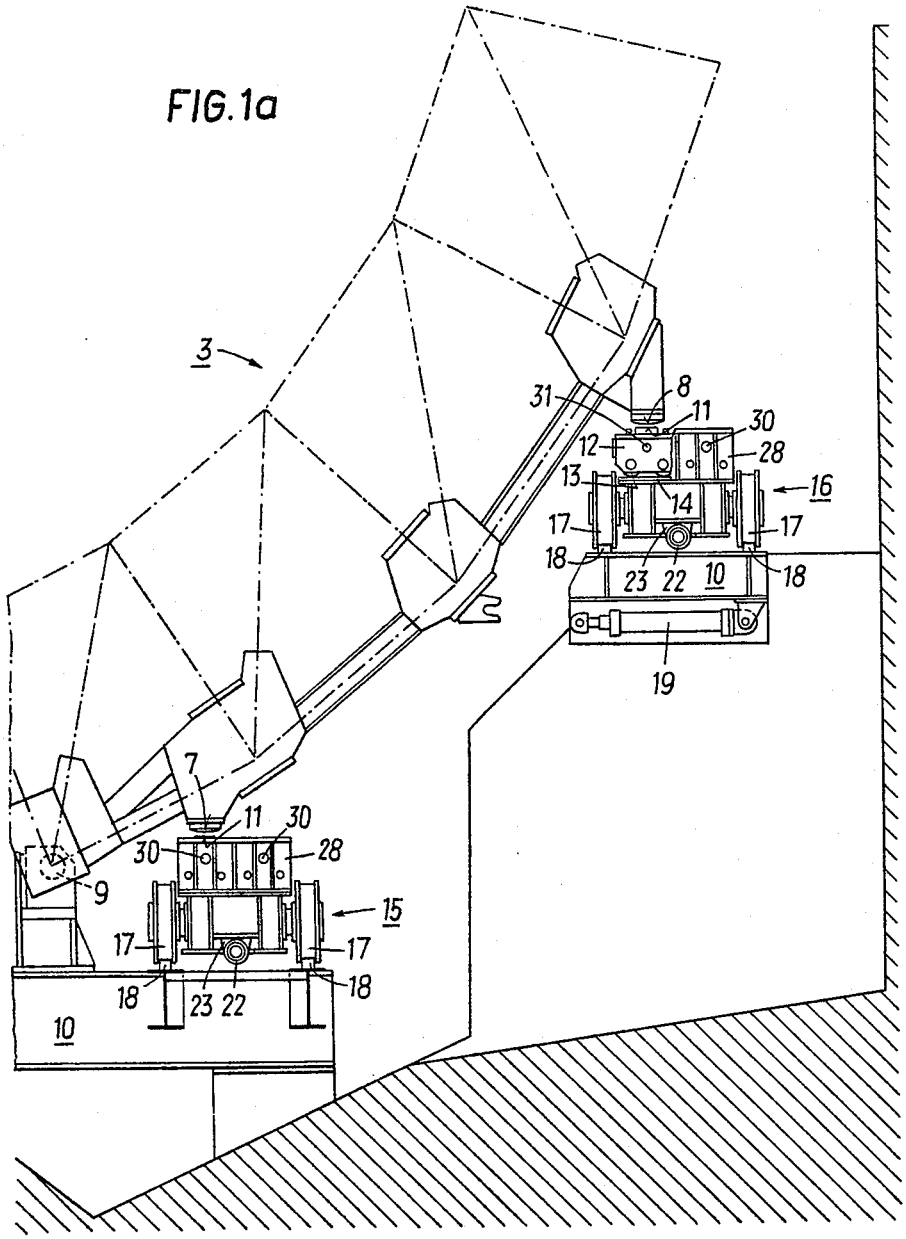
FIG. 1*a* is a detail thereof on an enlarged scale.

The intermediate trestles 12 are each laterally protected by plates 28 mounted on the respective supporting trestle 15, 16 and can be fixed on the plates 28 by pins 29 and thus in their positions relative to the supporting trestles 15, 16. Each pin 29 penetrates bores 31 of the intermediate trestles 12 and corresponding bores 30 of the plates 28. (See FIG. 1*a*).

The function of the arrangement when removing the supporting and guiding structure is the following:

At first, the supporting and guiding structure 3, after detachment of its fastening means 9 on the supporting trestle 10, is lowered by means of the lifting elements until it comes to lie with its supporting surfaces 7, 8 on the counter supporting surfaces 11 of the two intermediate trestles 12. Then the pressure medium cylinder 19 is coupled to the supporting and guiding structure 3 and the supporting and guiding structure is pulled outwardly in the direction of the arrow 33 (FIG. 2), with the help of the pressure medium cylinder 19, along the displacement path 32 of the intermediate trestles 12. The ends 34, 35 of the supporting and guiding structure 3 are thereby withdrawn out of engagement with the ends of neighbouring strand guide elements, i.e., the driving roll stand 4, which is arranged between the supporting and guiding structure 3 to be removed and the straightening aggregate 5, and the bending zone 2.

Subsequent to this movement of the supporting and guiding structure 3, the connection of the pressure medium cylinder 19 with the supporting and guiding structure is detached and the pressure medium cylinder 20 is actuated, its piston rod 21 being retracted by the stroke 25 of the pressure medium cylinder, whereby the supporting trestle 15, which is coupled to the pipe 22 by means of the pin 24, is moved by the stroke 25 of the piston rod 21 laterally, i.e., perpendicular to the arc plane (in the direction of arrow 36 in FIG. 3). After the removal of the pin 24, the piston rod 21 of the pressure medium cylinder 20 is again moved out until the second bore 27' of the pipe 22 is in alignment with the bore of the sleeve 23, then the sleeve 23 is again connected with the pipe 22 by means of the pin 24. Subsequently, the pressure medium cylinder 20 is again actuated and the supporting trestle 15 is further moved by the stroke 25. In this manner, both supporting trestles 15, 16 are stepwisely displaced.

It is of a particular advantage that no rope drives or chain drives need be used, which contaminate easily and are difficult to service, and, also, that no electromotors are required, which may lead to difficulties in the water-actuated cooling chamber. The connection of the piston rod 21 with the supporting trestle 15 and 16, respectively, necessitates only very coarse fits, i.e., the sleeve 23 may surround the pipe 22 quite loosely, so that this arrangement constantly remains in operation also in case of a strong contamination by rust and cinders. Also, the pressure medium cylinder 20, which exhibits only a short stroke 25, requires very little space and is, accordingly, less expensive.

Instead of the manually insertable pin 24, a ratchet-like device could be used, which would allow for movement of the sleeve relative to the pipe in one direction only. For moving the supporting and guiding structure 3 back, this device would have to be reversible, so that the relative movement may be carried out in the opposite direction.

The invention can be realized also for supporting and guiding structures that are arranged at shorter distances one after the other, each supporting and guiding structure being movable by at least one intermediate and supporting trestle.

What we claim is:

1. In a strand guide arrangement to be used in a continuous casting plant having the form of an arc, in particular a steel slab continuous casting plant of the type including at least one, arcuate, horizontally displaceable supporting and guiding structure, the improvement comprising, at least one intermediate trestle for mounting said at least one arcuate, horizontally displaceable supporting and guiding structure, said at least one intermediate trestle being displaceable in the plane of the arc, at least one supporting trestle for supporting said at least one intermediate trestle, said at least one supporting trestle being displaceable transversely to the plane of the arc, and a stationarily arranged pressure medium cylinder connectable to said supporting trestle for displacing said supporting and guiding structure at a right angle to the plane of the arc, said pressure medium cylinder having a stroke that is shorter than the total displacement path of said supporting trestle, said pressure medium cylinder including a piston rod having an extension, said supporting trestle being connectable to said extension at different distances from said pressure medium cylinder.

* * * * *